US006980753B2

(12) United States Patent
Yoshiki

(10) Patent No.: US 6,980,753 B2
(45) Date of Patent: Dec. 27, 2005

(54) DEVELOPING DEVICE FOR AN IMAGE FORMING APPARATUS AND BEARING SEAL STRUCTURE FOR THE SAME

(75) Inventor: Shigeru Yoshiki, Tokyo (JP)

(73) Assignee: Ricoh Company, Ltd., Tokyo (JP)

( * ) Notice: Subject to any disclaimer, the term of this patent is extended or adjusted under 35 U.S.C. 154(b) by 122 days.

(21) Appl. No.: 10/756,253

(22) Filed: Jan. 14, 2004

(65) Prior Publication Data

US 2004/0190929 A1 Sep. 30, 2004

(30) Foreign Application Priority Data

Jan. 23, 2003 (JP) ..... 2003-014487

(51) Int. Cl.[7] ..... G03G 15/08
(52) U.S. Cl. ..... 399/103; 399/105
(58) Field of Search ..... 399/98, 102, 103, 399/104, 105

(56) References Cited

U.S. PATENT DOCUMENTS

| | | | | |
|---|---|---|---|---|
| 5,255,059 | A | 10/1993 | Kai et al. | |
| 5,416,568 | A | 5/1995 | Yoshiki et al. | |
| 5,442,430 | A | 8/1995 | Ishii et al. | |
| 5,455,662 | A | 10/1995 | Ichikawa et al. | |
| 5,493,365 | A | 2/1996 | Matsui et al. | |
| 5,500,719 | A | 3/1996 | Ichikawa et al. | |
| 5,557,382 | A | 9/1996 | Tatsumi et al. | |
| 5,627,631 | A | 5/1997 | Ichikawa et al. | |
| 5,765,079 | A | 6/1998 | Yoshiki et al. | |
| 5,794,108 | A | 8/1998 | Yoshizawa et al. | |
| 5,822,663 | A | 10/1998 | Ichikawa et al. | |
| 5,828,935 | A | 10/1998 | Tatsumi et al. | |
| 5,909,610 | A | 6/1999 | Yoshiki et al. | |
| 5,918,090 | A | 6/1999 | Ichikawa et al. | |
| 5,970,290 | A | 10/1999 | Yoshiki et al. | |
| 6,075,963 | A | 6/2000 | Ichikawa et al. | |
| 6,289,195 | B1 | 9/2001 | Ichikawa et al. | |
| 6,295,425 | B1 * | 9/2001 | Garcia et al. | 399/103 |
| 6,418,293 | B2 | 7/2002 | Ichikawa et al. | |
| 6,606,468 | B2 | 8/2003 | Yoshiki | |

FOREIGN PATENT DOCUMENTS

JP 2001-125374 * 5/2001

* cited by examiner

*Primary Examiner*—Hoan Tran
(74) *Attorney, Agent, or Firm*—Oblon, Spivak, McClelland, Maier & Neustadt, P.C.

(57) ABSTRACT

A bearing seal structure of the present invention is applicable to a developing device included in an image forming apparatus. The structure includes two seal members included in a bearing portion and each having a respective elastic seal lip configured to seal the outer periphery of a shaft in contact therewith. Grease is sealed between the two seal members and between one of the seal members closer to the bearing portion than the other and the bearing portion.

9 Claims, 12 Drawing Sheets

DEVELOPING DEVICE FOR AN IMAGE FORMING APPARATUS AND BEARING SEAL STRUCTURE FOR THE SAME

BACKGROUND OF THE INVENTION

1. Field of the Invention

The present invention relates to a developing device for an image forming apparatus and more particularly to a bearing seal structure for stopping a developer or toner in a bearing portion included in a developing device.

2. Description of the Background Art

Today, the grain size of a developer or that of toner for use in the developing device of an image forming apparatus is decreasing for enhancing image quality. To cope with such a small grain size, a structure for sealing a bearing where toner, for example, is apt to leak to the outside has been proposed in various forms in the past. In one type of seal structure, a so-called V-ring, including an elastic seal lip, is simply fitted on a shaft that extends through a bearing case. More specifically, a V-ring, which is a specific form of a seal ring, is formed of rubber and provided with a generally V-shaped section including a body to be fitted on a shaft and an elastic seal lip positioned at one side of the body in the axial direction of the shaft.

In a seal structure of the type described above, grease is sometimes coated on the surface of a retainer, which the V-ring slidingly contacts, in a thin layer in order to prevent toner from leaking and to obviate noise ascribable to friction between the V-ring and retainer. Although the grease is coated in a thin layer so as not to be introduced in a developer, the amount of the grease is too small to preserve the effect of the grease over a long period of time. Further, it is likely that a developer contacts the grease and is mixed therewith because it is coated on the retainer. Moreover, the V-ring cannot sufficiently exhibit the expected sealing ability when it comes to toner having a small grain size, causing the toner to enter the sealing structure via the V-ring.

In light of the above, a G-seal may be used in combination with a V-ring. A G-seal is another conventional seal ring formed of rubber and having a generally G-shaped section that includes a body and an elastic seal lip formed integrally with the inner periphery of the body. The G-seal seals the outer periphery of a shaft by pressing it with the seal lip in the radial direction. The problem with this configuration is that toner passed through the V-ring adheres to a seal portion due to frictional heat generated between the G-seal and the shaft. Such toner grows in the form of masses and brings about defective images, locking and other problems when introduced into a developer via the seal portion.

The problems mentioned above arise little in a low-speed and a medium-speed image forming apparatus whose drive shafts rotate at speeds of, e.g., 315 rpm (revolutions per minute) and 411 rpm, respectively. However, when such a seal structure is applied to a high-speed image forming apparatus whose drive shaft. rotates at a speed as high as about 468 rpm, the above problems are apt to arise because the V-ring or the G-seal and the shaft of the retainer, frictionally contacting each other, generate a large amount of heat. For example, when a developing device included in a high-speed apparatus is continuously driven, the developing device is heated to about 50° C. with the result that the seal portion is apt to locally exceed 70° C., which is the softening point of toner, when heated.

To solve the problems stated above, Japanese Patent Laid-Open Publication No. 12-250309 proposes a bearing seal structure in which grease is sealed between a V-ring and a G-seal. This bearing seal structure, however, has a problem to be described later left unsolved.

On the other hand, Japanese Patent Laid-Open Publication No. 2001-125374 discloses a bearing seal structure including a seal portion in which a first and a second seal member, each having a respective elastic seal lip, contact the outer periphery of a shaft. Grease is sealed between the two seal members. The bearing seal structure, according to the above document, stably reduces slide loads and exhibits a desirable sealing effect and durability. Although this kind of structure has some advantages to be described later specifically, it is desirable to stably maintain the advantages over a long period of time.

SUMMARY OF THE INVENTION

It is an object of the present invention to provide a bearing seal structure capable of stably reducing slide loads and stably maintaining the sealing effect over a long period of time.

It is another object of the present invention to provide a developing device using the above bearing seal structure.

It is a further object of the present invention to provide an image forming apparatus including the above developing device.

A bearing seal structure of the present invention is applicable to a developing device included in an image forming apparatus. The structure includes two seal members included in a bearing portion and each having a respective elastic lip configured to seal the outer periphery of a shaft in contact therewith. Grease is sealed between the two seal members and between one of the seal members closer to the bearing portion than the other and the bearing portion.

BRIEF DESCRIPTION OF THE DRAWINGS

The above and other objects, features and advantages of the present invention will become more apparent from the following detailed description taken with the accompanying drawings in which.

DESCRIPTION OF THE PREFERRED EMBODIMENTS

To better understand the present invention, reference will be made to some different conventional seal structures for bearings.

Figure 1A:
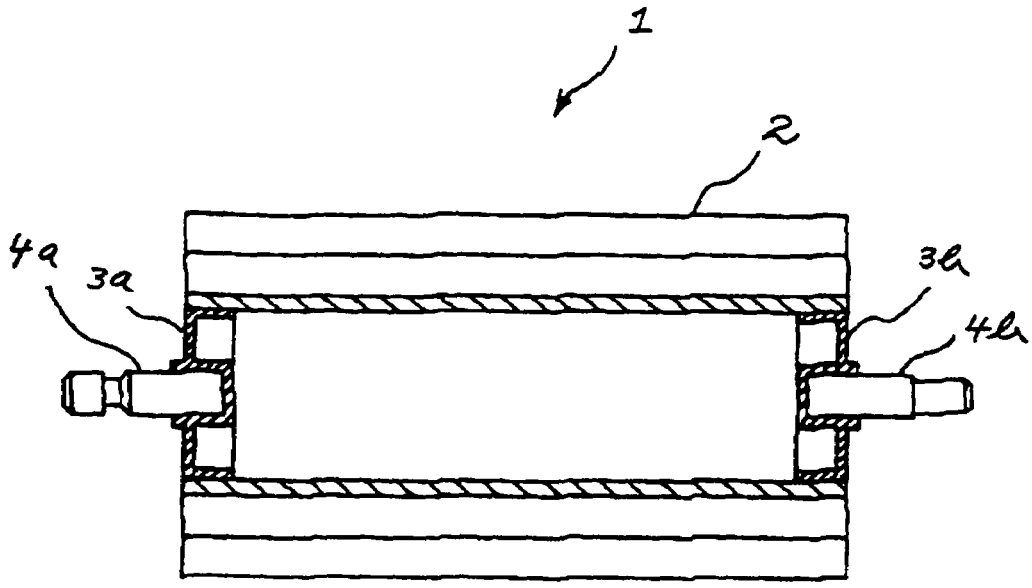
FIG. 1A PRIOR ART
FIG. 1A is a section showing a conventional paddle with a shaft press-fitted in opposite ends thereof.
Figure 1B:
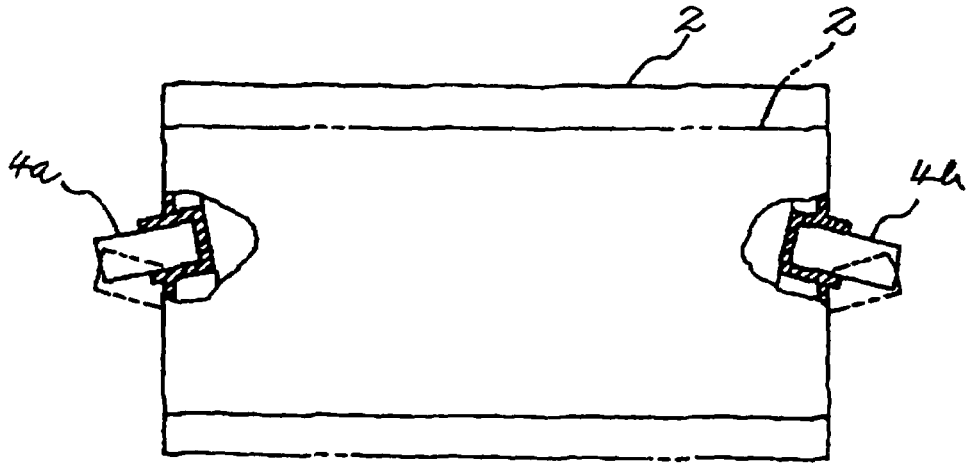
FIG. 1B PRIOR ART
FIG. 1B is a view for describing the problem of the paddle shown in FIG. 1A.

FIG. 1A shows a specific configuration of a conventional agitating member 1 included in a developing device. As shown, the agitating member 1 includes a blade body 2, which is a resin molding, and a pair of flanges 3*a* and 3*b* positioned at opposite ends of the blade body 2 and also comprising a resin molding each. Shaft members 4*a* and 4*b* are press-fitted in the flanges 3*a* and 3*b*, respectively. Although this configuration reduces the cost of the shaft members 4*a* and 4*b*, it is likely that the shaft members 4*a* and 4*b* are not fully aligned on the same axis, but are shifted from each other. For example, as shown in FIG. 1B, the shaft members 4*a* and 4*b* are apt to tilt due to deformation when subjected to some extraneous force and fail to be coaxial with the blade body 2 to the same degree as each other. As a result, the blade body 2 and shaft members 4*a* and 4*b* noticeably oscillate, as indicated by dash-and-dots lines in FIG. 1B.

Assume that G-seals are used as seal members for the shaft members 4*a* and 4*b*. Then, when the shaft members 4*a* and 4*b* noticeably oscillate while the agitating member 1 is in rotation, the G-seals are apt to fail to follow the oscillation of the contours of the shaft members 4*a* and 4*b*, causing toner to enter the resulting gaps between the above contours and the G seals and render sealing defective. Particularly, toner with a small grain size easily enters the above gaps even if the gaps are small. Further, the inside diameter of the G-seals is apt to increase due to the oscillation of the shaft members 4*a* and 4*b*, lowering the durability of the G seals. Although these problems arise little in a low-speed and a medium-speed machine whose drive shafts rotate at speeds of, e.g., 315 rpm and 411 rpm, respectively, the frequency of oscillation increases when the above configuration is applied to a high-speed machine whose drive shaft rotates at a speed of 465 rpm or 508 rpm.

Figure 2:
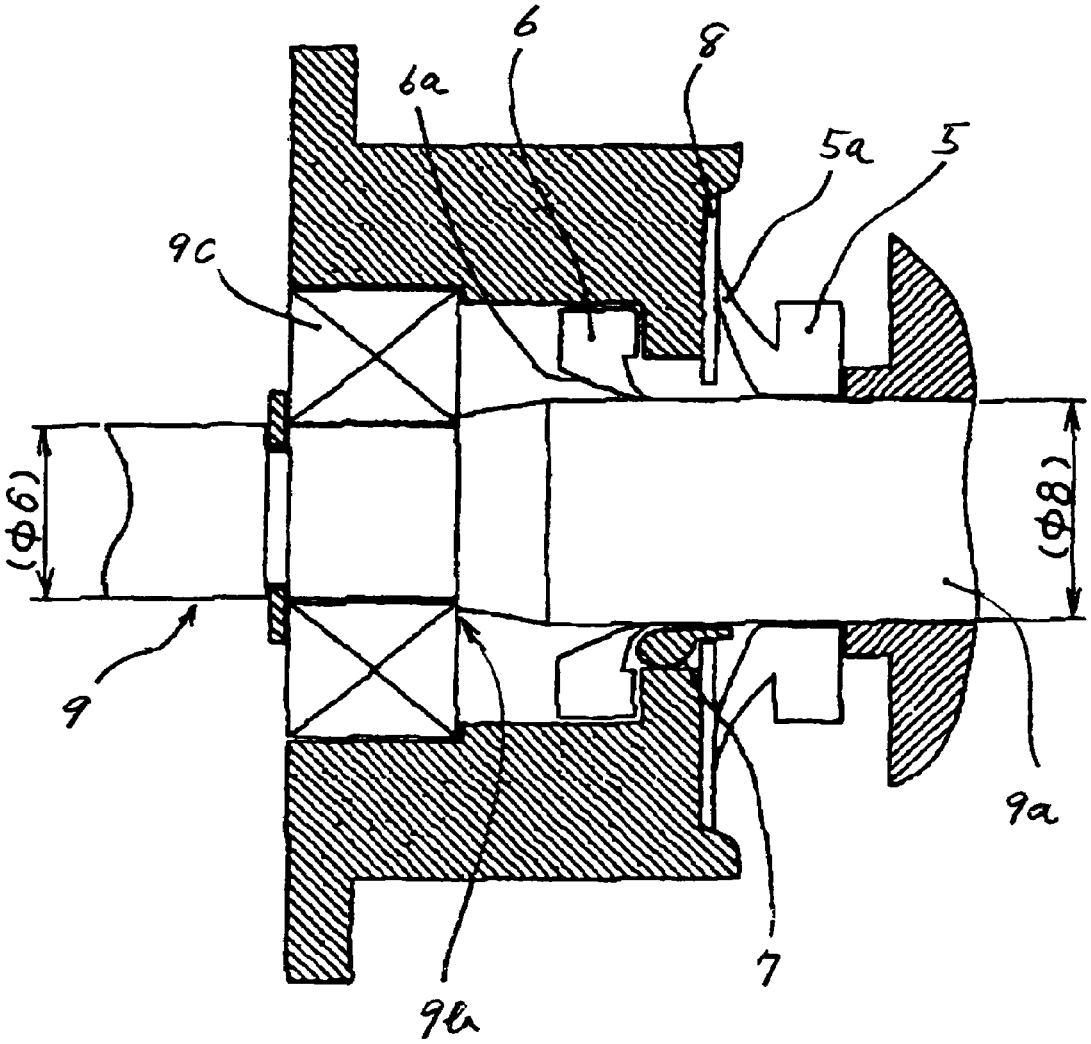
FIG. 2 PRIOR ART
FIG. 2 is a view showing a specific, conventional bearing seal structure.

FIG. 2 shows a bearing seal structure taught in Laid-Open Publication No. 12-250309 mentioned earlier. As shown, the seal structure includes a V-ring 5, a G-seal 6, and grease 7 sealed between the V-ring 5 and the G-seal 6. The grease 7, sealed between the V-ring 5 and the G-seal 6 in a sufficient amount, not only stably provides lubrication over a long period of time, but also stops toner that may enter via a seal portion between the V-ring 5 and a retainer 8.

In the bearing seal structure stated above, the V-ring 5 structurally must be positioned such that its seal lip 5*a* contacts the retainer 8 at a position remote from the periphery of the base portion 9*a* of a drive shaft 9. This brings about a problem that peripheral speed at the contact portion is high, generating a substantial amount of heat. For example, when the drive shaft 9 has a diameter of 6 mm, the V-ring 5 is fitted on the base portion 9*a* having a diameter of 8 mm because an anti-thrust step 9*b* is essential. As a result, the seal end of the V-ring 5 has a diameter as large as about 10 mm, so that the peripheral speed is about 1.7 times higher than when a G-seal is fitted on a drive shaft of the same diameter, i.e., 6 mm. It follows that when the V-ring 5 is applied to a high-speed machine, a sufficient margin against heat generation is not available. The V-ring 5 is therefore apt to fail to fully prevent toner from adhering to the surface of the retainer 8 due to heat. Labeled 9*c* in FIG. 2 is a ball bearing.

Although a G-seal is advantageous over a V-seal when consideration is given to the peripheral speed at the contact portion stated above, the former is, in many cases, inferior to the latter in the aspect of sealability. While two G-seals may be used in order to enhance sealability, as proposed in the past, toner is apt to accumulate between the G-seals and reach and adhere to a bearing during repeated operation.

Figure 3:
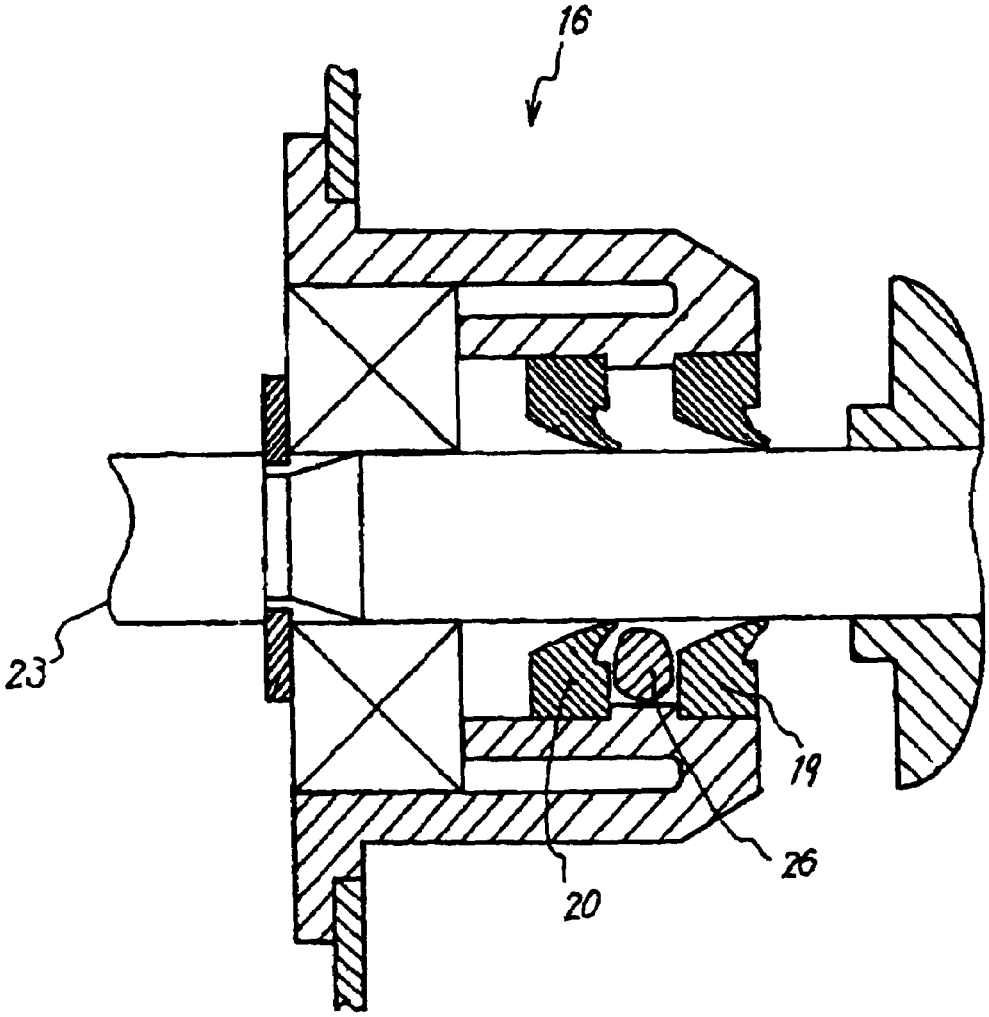
FIG. 3 PRIOR ART
FIG. 3 is a view showing another specific, conventional bearing seal structure.

FIG. 3 shows a bearing seal structure taught in Laid-Open Publication No. 2001-125374 also mentioned earlier and applied to a developing device included in an image forming apparatus. As shown, a bearing portion 16 includes a first and a second seal member 19 and 20 having respective elastic seal lips sealingly contacting the periphery of a shaft 23. Grease 26 is sealed between the first and second seal members 19 and 20. In this configuration, the seal members 19 and 20 contact the periphery of the shaft 23 at positions closer to the axis of the shaft 23 than a V-ring, which is another conventional seal member. For a given rotation speed of the shaft 23, the seal members 19 and 20 successfully reduce peripheral speed at their contact portions, compared to a V-ring. Consequently, slide loads between the seal members 19 and 20 and the shaft 23 decrease, so that the adhesion of toner ascribable to frictional heat occurs little.

Further, the grease 26 between the seal members 19 and 20 not only stops toner entered the space between the seal members 19 and 20, but also implements lubrication for thereby obviating toner adhesion ascribable to heat. In addition, because the above space is closed by the seal members 19 and 20, the grease 26 does not leak to the outside of the space and therefore insures stable sealing over a long period of time.

However, when the developing device with the seal structure shown in FIG. 3 is operated over a long period of time, toner, entered the space between the two seal members 19 and 20, sometimes reaches the bearing portion 16 via the seal member 20 without being stopped by the grease 26. Such toner reaches the gap between the shaft 23 and the bearing portion 16 and adheres therein, increasing a drive load to act on the shaft 23. The resulting wear and heat generated between the shaft 23 and the bearing portion 16 are apt to bring about defective drive and other troubles.

Preferred embodiments of the bearing structure in accordance with the present invention will be described hereinafter.

First Embodiment

Figure 4:
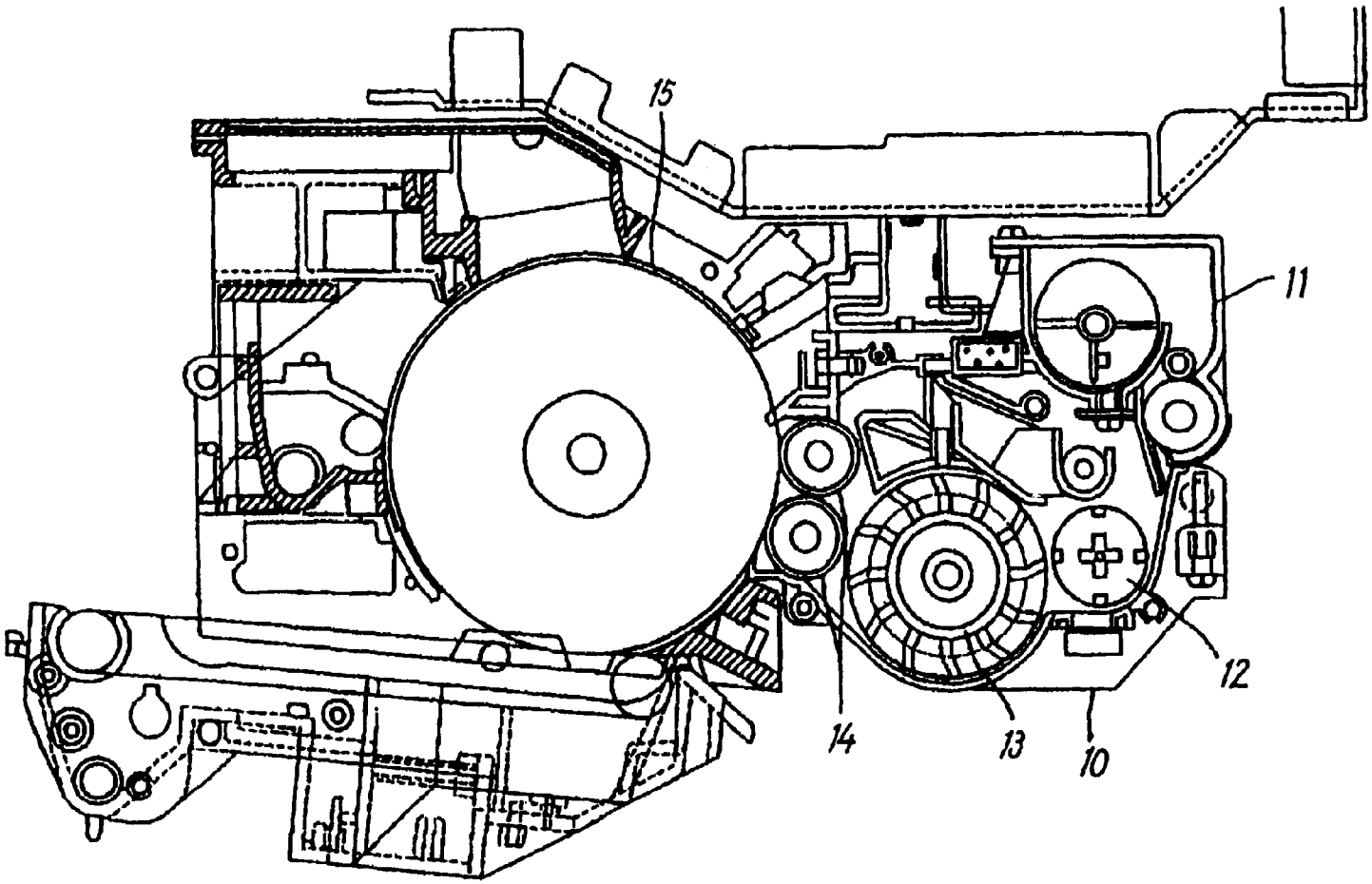
FIG. 4 is a view showing the general construction of an image forming apparatus to which the present invention is applied.

Referring to FIG. 4, an image forming apparatus to which the present invention is applied is shown and includes a developing device 10, which stores a two-component type developer or toner and carrier mixture. When toner present in the developer becomes short, fresh toner is replenished from a replenishing portion 11 via a replenishing roller 12. The developer thus replenished with toner is agitated by a paddle or agitating member 13 and then magnetically deposited on a sleeve 14 for thereby developing a latent image formed on a photoconductive drum 15.

Briefly, a seal structure included in the illustrative embodiment is implemented by rubber or similar elastic seal members and applied to the drive input side of a shaft on which the paddle 13 is mounted (paddle shaft hereinafter) and a bearing associated therewith.

Figure 5:
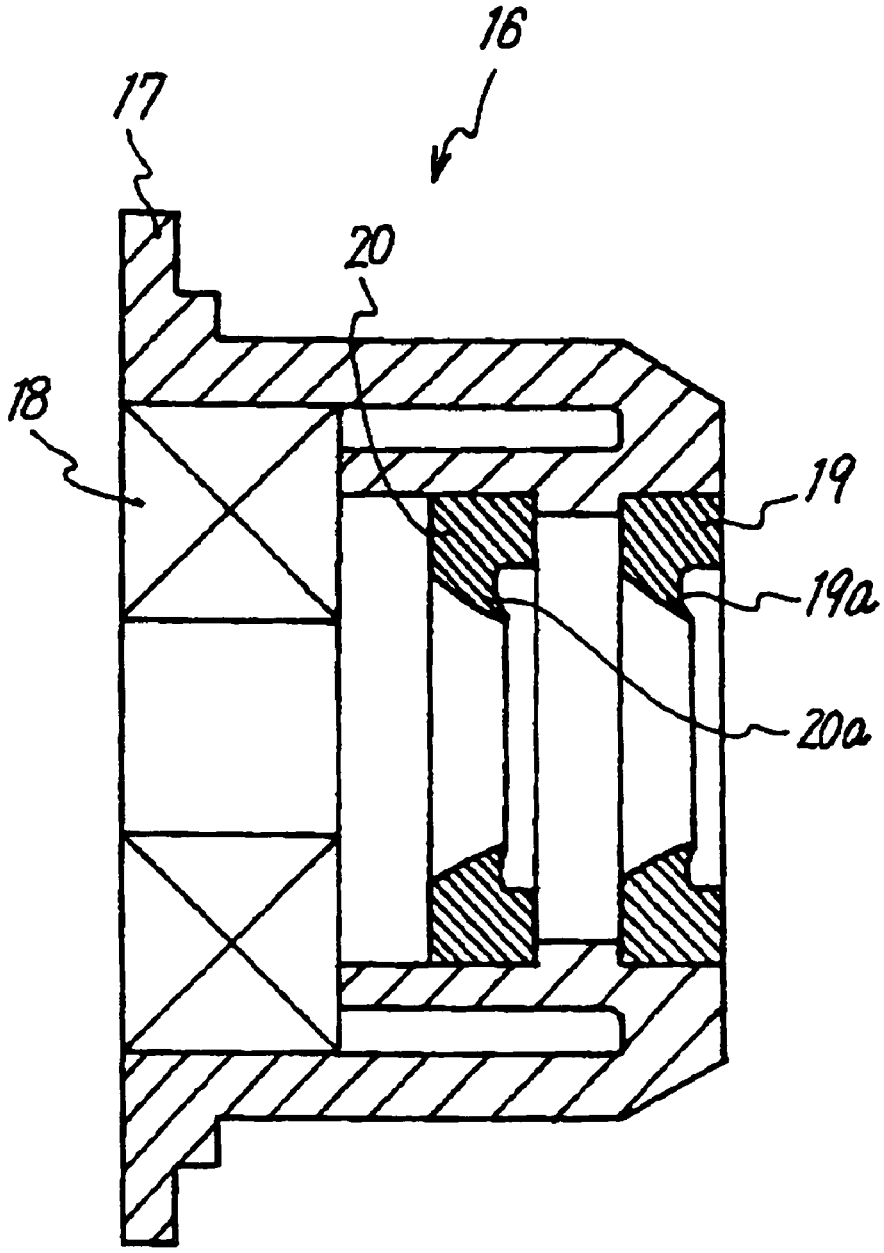
FIG. 5 is a section showing a first embodiment of the bearing seal structure in accordance with the present invention.

More specifically, as shown in FIG. 5, a bearing 16 is generally made up of a bearing case or holding member 17, a ball bearing 18, and a first and a second annular G-seal 19 and 20. The annular G-seals 19 and 20 are formed of fluororubber or similar elastic material and configured as seal rings that press the paddle shaft, not shown, in the radial direction with their seal lips protruding radially inward. The bearing case 17 comprises a molding of polyacetal resin or similar crystalline resin. After the first G-seal 19, applicable to a shaft whose diameter is 8mm by way of example, has been press-fitted in the bearing case 17 from the right, the second G-seal 20 is press-fitted in the same from the left, and then the ball bearing 18, also applicable to a 8 mm shaft, is press-fitted.

Experience teaches that a molding of polyacetal resin or similar crystalline resin cracks less than a molding of ABS (Acrylonitrile-Butadiene-Styrene) or similar resin when subject to the influence of grease and stresses. Therefore, the bearing case 17, implemented as a molding of polyacetal resin, cracks little despite the grease and stresses ascribable to the press-fitting of the seal members 19 and 20, thereby preventing grease from leaking to the outside. It follows that stable sealing is insured over a long period of time. PBT (PolyButylene-Terephthalate) is another crystalline resin applicable to the bearing case 17. Further, the bearing case 17 formed of resin is low cost.

Figure 6A:
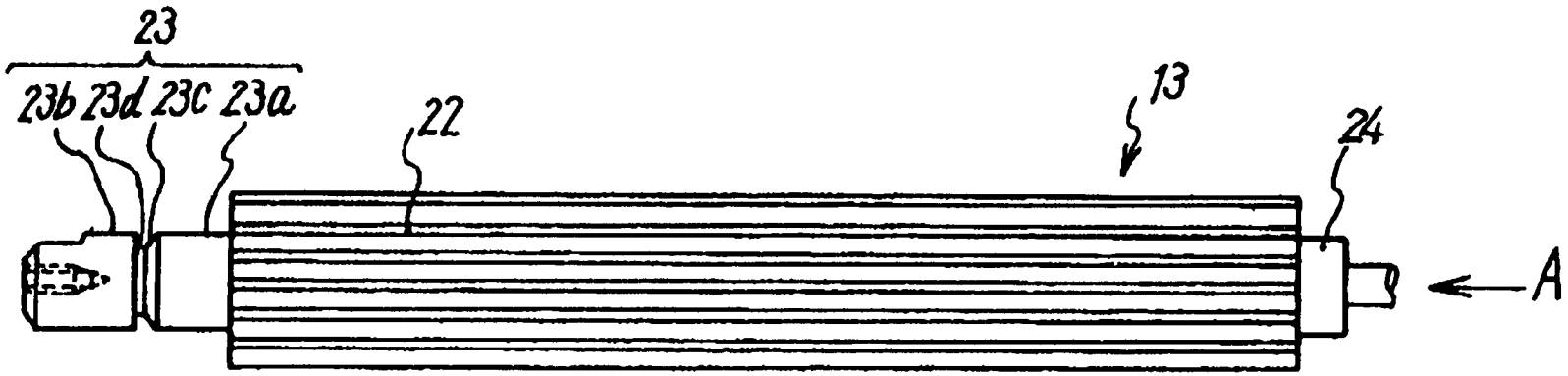
FIG. 6A is a front view showing a paddle included in the first embodiment.
Figure 6B:
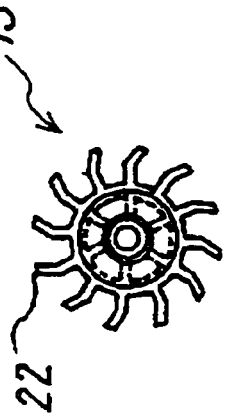
FIG. 6B is a side elevation as seen in a direction indicated by an arrow A in FIG. 6A.

As shown in FIG. 6A, the paddle 13 includes a blade member 22 implemented as a molding of PVC (PolyVinyl Chloride) or similar resin and a pair of paddle shafts 23 and 24 positioned at opposite ends of the blade member 22. The paddle shafts 23 and 24 are formed of stainless steel or similar metal. The paddle shaft 23 is made up of a base portion 23*a* supported by the bearing 16 at the blade member 22 side, an end portion 23*b*, a tapered connecting portion 23*c* connecting the two portions 23*a* and 23*b*, and an annular groove 23*d* for receiving an E-ring not shown. The connecting portion 23*c* is tapered in order to prevent the G-seals 19 and 20, FIG. 5, from being caught and turned up by the step of the groove 23*d* when the bearing 16 is mounted to the paddle shaft 23. FIG. 6B shows the paddle 13 in a side elevation as seen in a direction indicated by an arrow in FIG. 6A.

Figure 7:
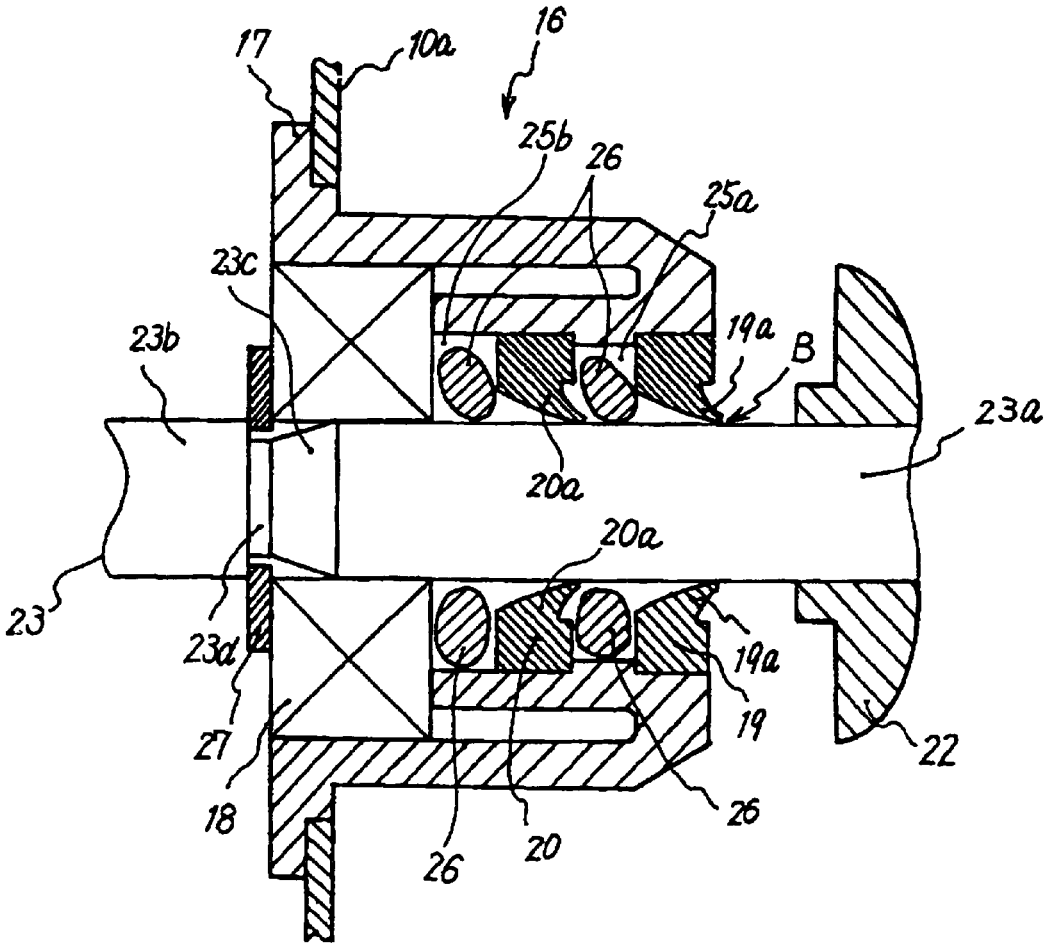
FIG. 7 is a section showing the bearing seal structure of the illustrative embodiment.

As shown in FIG. 7 in detail, the first and second G-seals 19 and 20 respectively include elastic seal lips 19*a* and 20*a*. A space 25*a* is formed between the seal lips 19*a* and 20*a*, the inner periphery of the bearing case 17 and the base portion 23*a* of the paddle shaft 23 and coated with an amount of grease 26 that substantially fills up the space 25*a*. Likewise, a space 25*b*, formed between the seal lip 20*a*, the ball bearing 18 and the inner periphery of the bearing case 17, is coated with an amount of grease 26 that substantially fills up the space 25*b*.

The space 25*a* exists between the first and second G-seals 19 and 20 while the space 25*b* exists between the G-seal 20 closer to the bearing portion than the G-seal 19 and the bearing portion. The total amount of grease applied to the two spaces 25*a* and 25*b* is, e.g., 0.15 g or above. For the grease, use may be made of, but not limited to, G501 (trade name) available from Shin-Etsu Silicone Co., Ltd. To prevent the grease from being mixed with a developer, it is necessary to prevent the grease from spreading to the outside of the bearing via the G-seal 19.

After the grease has been coated in the two spaces 25*a* and 25*b*, the paddle shaft 23 is passed through the bearing 16 and then mounted to a side wall 10*a* included in the developing device 10. Subsequently, an E-ring 23*d* is fitted in the groove 23*d* formed in the end portion 23*b* of the paddle shaft 23. In FIG. 7, the portion rightward of the side wall 10*a* and the portion leftward of the same are respectively the inside and the outside of the developing device 10. A joint with a gear, not shown, is mounted on the end of the end portion 23*b* and fastened thereto by a screw not shown. The output torque of a drive motor, not shown, is transmitted to the joint to thereby drive the sleeve 14 and other rotatable members via the gear.

The grease 26, sealed in the space 25*a* between the two G-seals 19 and 20, lubricates the interface between the G-seal 19 and the base portion 23*a* of the paddle shaft 23 and the interface between the G-seal 20 and the base portion 23*a* to thereby reduce frictional heat and prevent toner entered via the G-seal 19, as indicated by an arrow B, from adhering at the above interfaces. Further, the grease 26, sealed in a sufficient amount, is capable of stopping the toner alone. Moreover, because the space 25*a* is surrounded by the seal lips 19*a* and 20*a* of the G-seals 19 and 20, the grease 26 does not leak to the outside and constantly provides stable lubrication at the interfaces mentioned above.

Likewise, the grease 26, sealed in the space 25*b* between the G-seal 20 and the ball bearing 18, lubricates the interface between the G-seal 20 and the base portion 23*a* of the paddle shaft 23 and the interface between the ball bearing 18 and the base portion 23*a* to thereby reduce frictional heat and prevent toner entered via the G-seal 20 from adhering at the above interfaces. Further, the grease 26, sealed in a sufficient amount, is capable of stopping the toner alone. Moreover, because the space 25*b* is delimited by the seal lip 20*a* of the G-seal 20 and the ball bearing 18, the grease 26 does not leak to the outside and constantly provides stable lubrication at the interfaces mentioned above.

The G seals 19 and 20, formed of rubber or similar elastic material and contacting metal, fully prevent the grease 26 from leaking and being introduced into the developer, so that images are free from defects ascribable to the cohesion of the developer otherwise caused by the grease.

The G-seal 19, which is a first seal member and disposed in the developing device 10, is substituted for the conventional V-ring 5. The seal lip 5*a* of the V-ring 5 contacts the retainer 8 at a position remote from the periphery of the base portion 9*a* of the paddle shaft 9 and therefore brings about the problem stated earlier with reference to FIG. 2. By contrast, as shown in FIG. 7, the seal lip 19*a* of the G-seal 19 contacts the periphery of the base portion 23*a* of the paddle shaft 23 and therefore reduces peripheral speed at the contact portion, compared to the V-ring 5. This successfully reduces heat to be generated for thereby obviating the cohesion of toner.

Further, when the V-ring 5 is used, the anti-thrust step 9*b* is essential with the paddle shaft 9, so that the portion of the paddle shaft 9 where the ball bearing 9*b* is fitted must be larger in diameter than the portion where the V-ring 5 is fitted, as also stated earlier with reference to FIG. 2. Such an anti-thrust step is not necessary for the G-seal 19. Therefore, the portion of the paddle shaft 23 where the ball bearing 18 is fitted and the portion of the same which the lips 19*a* and 20*a* of the G-seals 19 and 20 contact can be provided with the same diameter.

In the illustrative embodiment, the bearing 16 is mounted to the paddle shaft 23 after the paddle shaft 3 has been mounted to the blade member 22. In this case, the portion of the paddle shaft 23 which the lips 19*a* and 20*a* contact has the minimum diameter when it has the same diameter as the portion where the ball bearing 18 is fitted. For this reason, it is possible to use the G-seals 19 and 20 having the minimum allowable diameter and therefore to minimize the peripheral speed at the seal portion or contact portion, i.e., the slide load to act on the seal portion, thereby allowing a minimum of wear and heat generation to occur at the seal portion.

While the amount of the grease 26 great enough to substantially fill up the spaces 25*a* and 25*b*, e.g., 0.15 g or above is selected in the illustrative embodiment, the amount is open to choice if it is 0.15 g or above that implements both of sealing and lubrication. The bearing case 17 may be implemented as part No. B0103170 by way of example. The amount of the grease 26, substantially filling up the spaces 25*a* and 2, may be suitably selected in accordance with, e.g., the configurations of the bearing case 17 and G-seals 19 and 20.

The G-seals 19 and 20 each may be replaced with an oil seal comprising a metal ring and rubber, if desired.

A first and a second modification of the illustrative embodiments will be described hereinafter. In a first modification, the bearing case 17 is implemented as a molding of crystalline resin, ABS or similar resin containing glass fibers. As shown in FIG. 7, the first and second G-seals 19 and 20 are press-fitted in the bearing case 17, so that the press-fit portion of the bearing case 17 must be provided with accurate inside diameter. If the inside diameter of the bearing case 17 and the outside diameter of the paddle shaft 23 are not coaxial, then the sealing ability of the seal lips 19*a* and 20*a* is lowered while the seal lips 19*a* and 20*a* are caused to locally wear themselves, reducing the life of the G-seals 19 and 20. In this respect, glass fibers, contained in the resin of the bearing case 17, provide the bearing case 17 with high accuracy by reducing shrinkage ascribable to molding and therefore accurately maintain the inside diameter of the seal lips 19*a* and 20*a* and the outside diameter of the base portion 23*a* coaxial with each other. This insures a high sealing ability and protects the seal lips 19*a* and 20*a* from local wear for thereby enhancing the durability of the G-seals 19 and 20.

Further, glass fibers particular to the first modification reduces cracking of the bearing case 17 ascribable to the grease and stresses particular to the press-fitting of the G-seals 19 and 20. This obviates cracks that would cause the grease 26 to leak to the outside of the bearing case 17, thereby stably insuring a desirable sealing effect over a long period of time.

In a second modification, the bearing case 17 is formed of aluminum or similar metal instead of resin and produced by machining. The bearing case 17 achieves higher mechanical strength and accuracy when formed of metal than when implemented as a resin molding and is therefore free from cracks and achieves a high sealing ability and durability.

Second Embodiment

Figure 8:
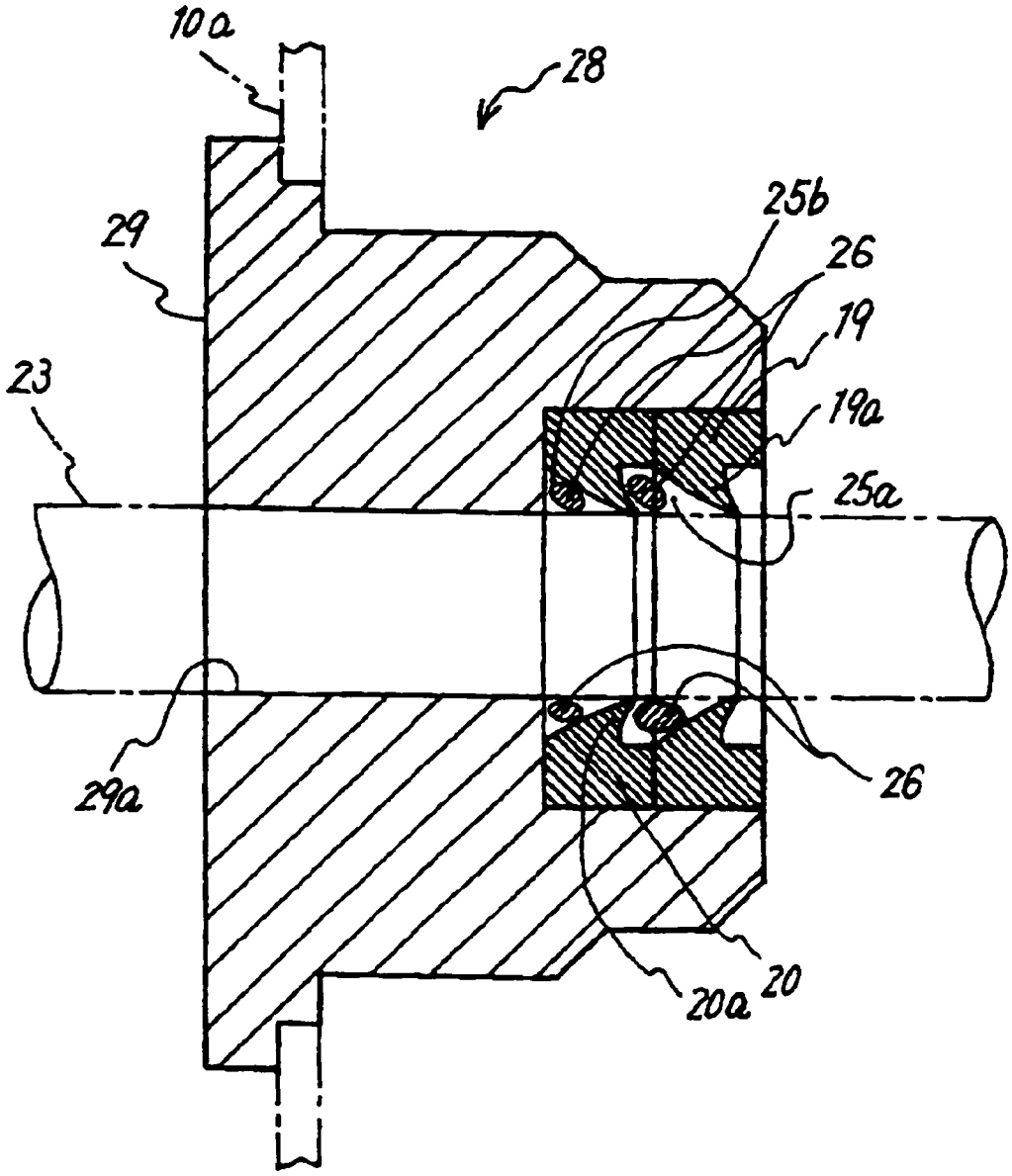
FIG. 8 is a section showing a second embodiment of the present invention.

A second embodiment of the present invention will be described with reference to FIG. 8. As shown, a slide bearing 28 is substituted for the ball bearing 18 of the first embodiment and modifications thereof. The slide bearing 28 is made up of a bearing case 29 and the first and second G-seals 19 and 20. The bearing case 29 is implemented as a molding of polyacetal resin or similar crystalline resin and formed of a slide bearing portion 29*a* at its center. After the second G-seal 20, adapted for a 6 mm shaft and formed of fluororubber by way of example, has been press-fitted in the bearing case 29 from the right, as viewed in FIG. 8, the first G-seal 19 is press-fitted. In the illustrative embodiment, the shaft diameter to which the G-seals 19 and 20 are applicable and the shaft diameter to which the slide bearing portion 29*a* is applicable are the same as each other, so that the peripheral speed of the paddle shaft 23, slidingly contacting the seal lips 19*a* and 20*a*, and therefore heat generation is minimized.

The amount of the grease 26 is selected in such a manner as to substantially fill up the space 25*a* delimited by the seal lips 19*a* and 20*a*, the inner periphery of the bearing case 29 and the outer periphery of the paddle shaft 23. Also, the amount of the grease 26 is selected in such a manner as to substantially fill up the space 25*b* delimited by the seal lip 20*a*, the inner periphery of the bearing case 29 and the outer periphery of the paddle shaft 23. The grease 26 in the space 25*a* lubricates the interface between the first G-seal 19 and the paddle shaft 23 and the interface between the second G-seal 20 and the paddle shaft 23, thereby reducing frictional heat that would cause toner entered via the first G-seal 19 to adhere to the above interfaces. Also, the amount of the grease 26 is great enough to stop the above toner alone. Further, the grease 26 in the space 25*a*, delimited by the lips 19*a* and 20*a*, is prevented from leaking to the outside and constantly present in the slide portions of the G-seals 19 and 20, stably lubricating the slide portions.

Likewise, the grease 26 in the space 25*b* lubricates the interface between the second G-seal 20 and the paddle shaft 23 and the interface between the slide bearing 28 and the paddle shaft 23, thereby reducing frictional heat that would cause toner entered via the second G-seal 20 to adhere to the above interfaces. Also, the amount of the grease 26 is great enough to stop the above toner alone. Further, the grease 26 in the space 25*b*, delimited by the lip 20*a* and the inner periphery of the bearing case 29, is prevented from leaking to the outside and constantly present in the slide portion between the G-seal 20 and the slide bearing 29, stably lubricating the slide portion.

The G-seals 19 and 20, formed of rubber or similar elastic material and contacting metal, fully prevent the grease 26 from leaking and being introduced into the developer, so that images are free from defects ascribable to the cohesion of the developer otherwise caused by the grease.

The slide bearing 28 particular to the illustrative embodiment is applied to a shaft on which a lighter load than in the first embodiment and modifications thereof acts, contributing to cost reduction.

Third Embodiment

Figure 9:
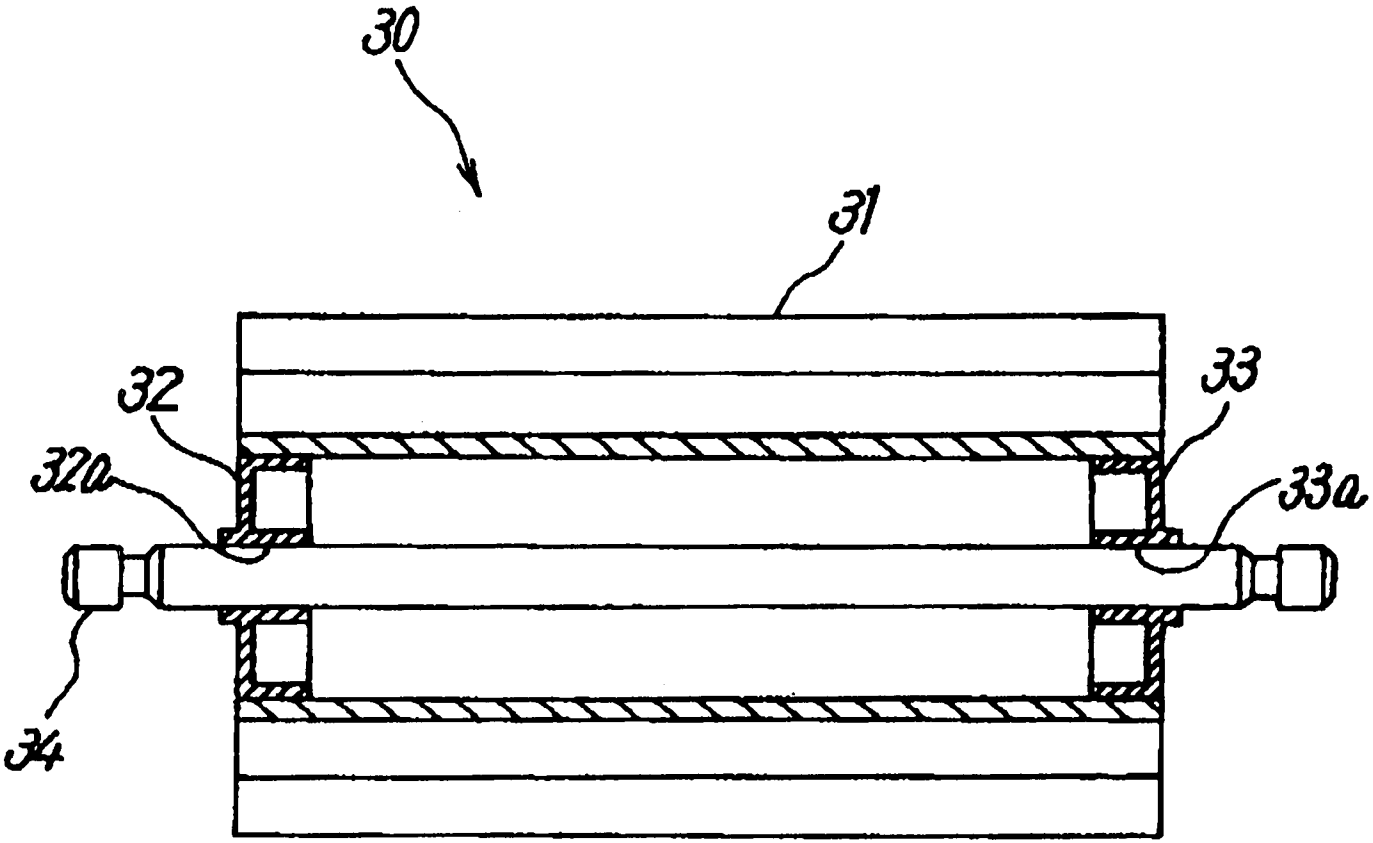
FIG. 9 is a section showing a paddle representative of a third embodiment of the present invention.
Figure 10:
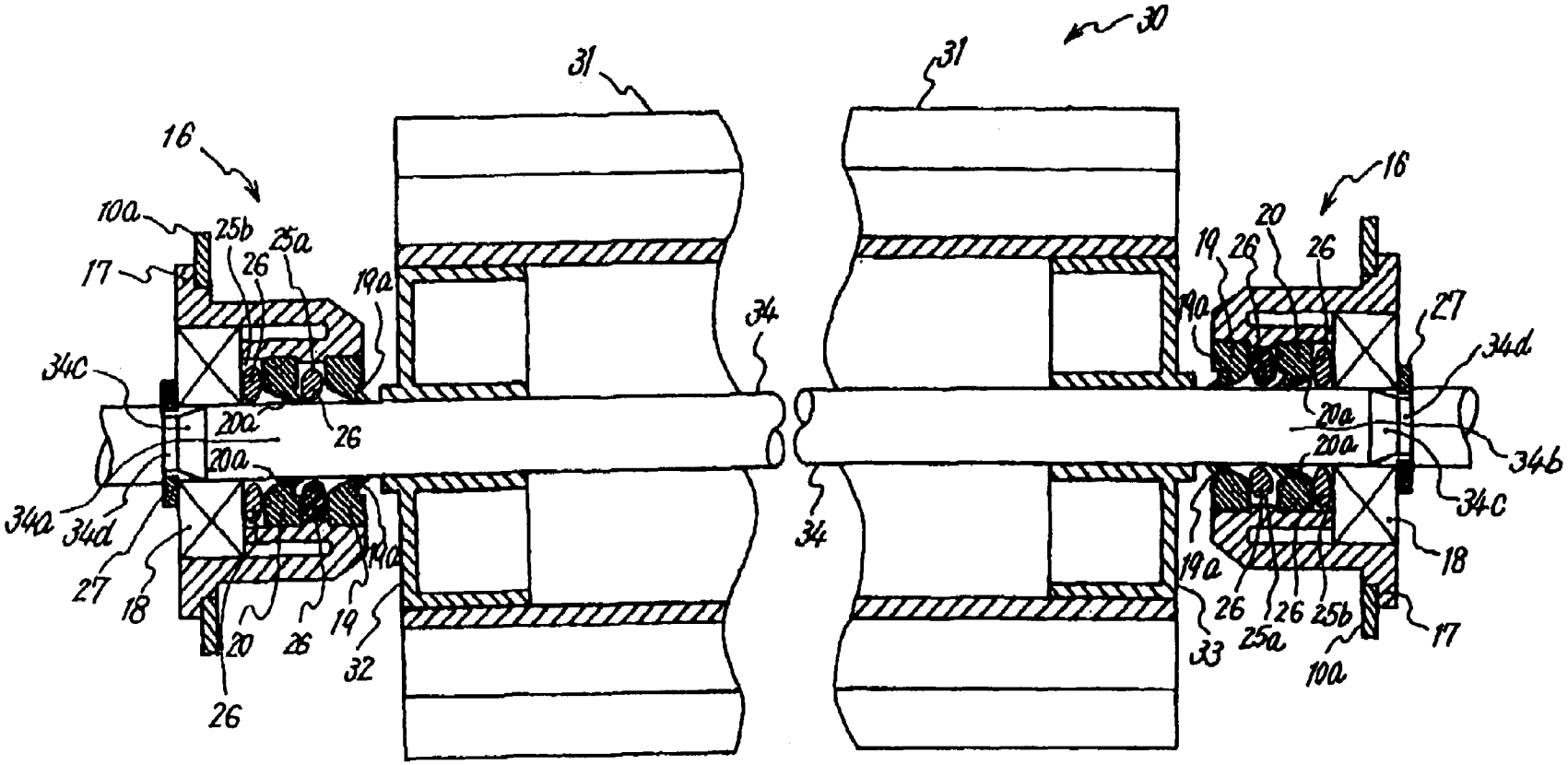
FIG. 10 is a section showing the paddle of the third embodiment supported by ball bearings.

Reference will be made to FIGS. 9 and 10 for describing a third embodiment of the present invention. As shown in FIG. 9, a paddle 30 has a single paddle shaft instead of the two paddle shafts 23 and 24 included in the first embodiment and modifications thereof. More specifically, the paddle 30 is made up of a blade body 31, a pair of flanges 32 and 33 positioned at opposite ends of the blade body 31, and a single paddle shaft 34 extending throughout the paddle 30. The paddle shaft 34, formed of stainless steel by way of example, is passed through holes 32*a* and 32*b* formed in the flanges 32 and 33, respectively.

FIG. 10 shows the paddle shaft 34 supported at opposite ends thereof by the bearings 16, which are implemented by the ball bearings 18 included in the first embodiment. As shown, shaft portions 34*a* and 34*b*, positioned at opposite ends of the paddle shaft 34, are respectively supported by two bearings 16 mounted on the side walls 10*a* of the developing device, so that the paddle 30 is rotatably supported. The shaft portions 34*a* and 34*b* each are formed with a tapered portion 34*c* in order to prevent the first and second G-seal 19 and 20 from being caught and turned up by the step of a groove 34*d* when the bearing 16 is mounted to the paddle shaft 34. The groove 34*d* is configured to receive an E-ring.

A procedure for mounting the paddle 30 to the developing device will be described hereinafter. First, at each end of the paddle 30, the grease 26 sufficient in amount to substantially fill up the space 25*a*, which is delimited by the seal lips 19*a* and 20*a*, the inner periphery of the bearing case 17 and the outer periphery of the paddle 34, is coated in the space 25*a*. Likewise, the grease 26 sufficient in amount to substantially fill up the space 25*b*, which is delimited by the seal lip 20*a*, ball bearing 18, the inner periphery of bearing case 17 and the outer periphery of the paddle shaft 23, is coated in the space 25*b*. The total amount of grease applied to the two spaces 25*a* and 25*b* is, e.g., 0.15 g or above. For the grease, use may be made of, but not limited to, G501 mentioned earlier. To prevent the grease from being mixed with a developer, it is necessary to prevent the grease from spreading to the outside of the bearing via the G-seal 19. Subsequently, the bearings 16 are respectively fitted on the shaft portions 34*a* and 34*b* of the paddle shaft 34 and then mounted to the side walls 10*a* of the developing device. Thereafter, E-rings 27 are fitted in the grooves 34*d* of the shaft portions 34*a* and 34*b* so as to prevent the paddle shaft 34 from slipping out.

Assuming that the left bearing portion 34*a*, as viewed in FIG. 10, is the drive input side, then a joint with a gear, not shown, is mounted to the end of the shaft portion 34*a* and then fastened by a screw. In this configuration, the output torque of a drive motor, not shown, is transmitted to the joint to thereby drive the sleeve 14 and other rotary members via the gear.

In the illustrative embodiment, the shaft portions 34*a* and 34*b* positioned at opposite ends of the paddle shaft 34, which extends throughout the blade body 31, can be surely maintained coaxial with each other, compared to separate shaft members each being press-fitted in a particular flange. In addition, the single paddle shaft 34 is free from the problem stated with reference to FIGS. 1A and 1B.

Further, the diameter of the portion where the ball bearing g18 is fitted and the portion which the G-seals 19 and 20 contact can be provided with the same diameter. This makes it needless to form a step by machining the above two portions to the same diameter, obviating the oscillation of the shaft portions ascribable to machining errors.

Moreover, each bearing 16, implemented by the ball bearing 18, can be fitted on the paddle shaft 34 with a smaller play than a slide bearing, which will be described later, so that the play of the G-seals 19 and 20 is also small. This further enhances the sealing ability. For example, the inside diameter of an inner race included in a ball bearing has a tolerance of 0 mm to −0.008 mm, the inside diameter of a slide bearing, formed of polyacetal resin by way of example, has a tolerance of +0.05 mm to 0 mm.

As stated above, the paddle 30 of the illustrative embodiment causes the paddle shaft 34 to oscillate little during rotation and therefore obviates gaps otherwise produced between the G-seals 19 and 20 and the outer periphery of the paddle shaft 34, thereby preventing toner from entering the bearings 16. Also, the seal lips 19*a* and 20*a* are prevented from being spread due to the influence of the oscillation of the paddle shaft 34 and therefore achieve sufficient durability.

Furthermore, the portion of the paddle shaft 34 where the ball bearing 18 is fitted and the portion which the seal lips 19*a* and 20*a* contact can be provided with the same diameter as each other. For this reason, it is possible to use the G-seals 19 and 20 having the minimum allowable diameter and therefore to minimize the peripheral speed at the seal portion or contact portion, i.e., the slide load to act on the seal portion, thereby allowing a minimum of wear and heat generation to occur at the seal portion.

The bearings 16 may, of course, be formed of resin containing glass fibers as in the first modification or formed of metal as in the second modification.

Fourth Embodiment

Figure 11:
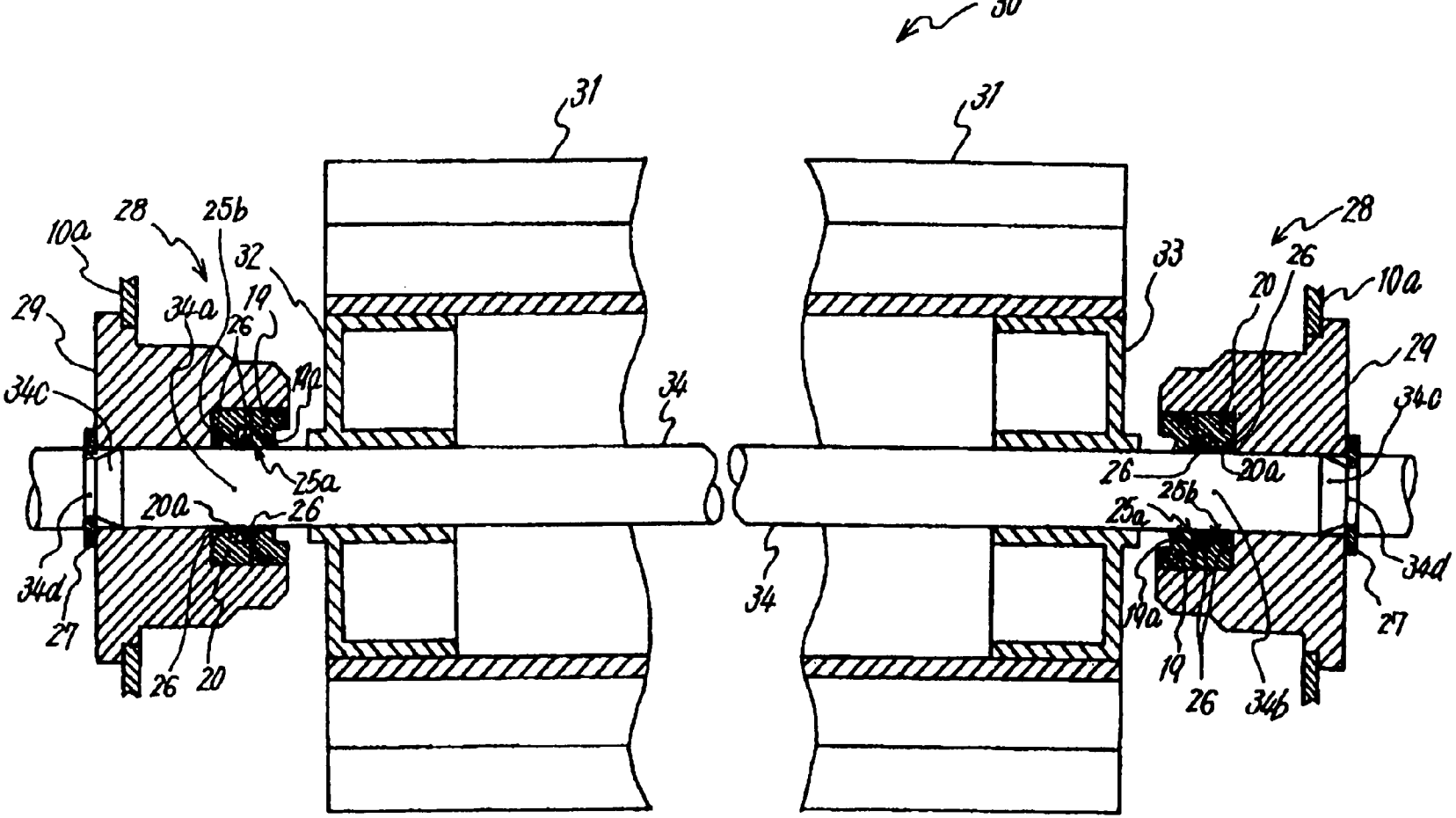
FIG. 11 is a section showing a paddle representative of a fourth embodiment of the present invention and supported by slide bearings.

FIG. 11 shows a fourth embodiment of the present invention. As shown, the fourth embodiment differs from the third embodiment in that the slide bearings 28 are substituted for the ball bearings 18. As for the rest of the configuration, the fourth embodiment is identical with the third embodiment. FIG. 11 shows the paddle shaft 34 supported at opposite ends thereof by the slide bearings 28 stated in relation to the second embodiment.

A procedure for mounting the paddle 30 to the developing device will be described hereinafter. First, at each end of the paddle 30, the grease 26 sufficient in amount to substantially fill up the spaces 25*a* and 25*b* is coated in the spaces 25*a* and 25*b*. Subsequently, the bearings 28 are respectively fitted on the shaft portions 34*a* and 34*b* of the paddle shaft 34 and then mounted to the side walls 10*a* of the developing device. Thereafter, the E-rings 27 are fitted in the grooves 34*d* of the shaft portions 34*a* and 34*b* so as to prevent the paddle shaft 34 from slipping out.

Assuming that the left bearing portion 34*a*, as viewed in FIG. 11, is the drive input side, then a joint with a gear, not shown, is mounted to the end of the shaft portion 34*a* and then fastened by a screw. In this configuration, the output torque of a drive motor, not shown, is transmitted to the joint to thereby drive the sleeve 14 and other rotary members via the gear.

As stated above, in the illustrative embodiment, as in the third embodiment, the paddle 30 causes the paddle shaft 34 to oscillate little during rotation and therefore obviates gaps otherwise produced between the G-seals 19 and 20 and the outer periphery of the paddle shaft 34, thereby preventing toner from entering the slide bearings 28. Also, the seal lips 19*a* and 20*a* are prevented from being spread due to the influence of the oscillation of the paddle shaft 34 and therefore achieve sufficient durability.

The slide bearings 28 are applied to a shaft on which a relatively light load acts, contributing to cost reduction.

Figure 12:
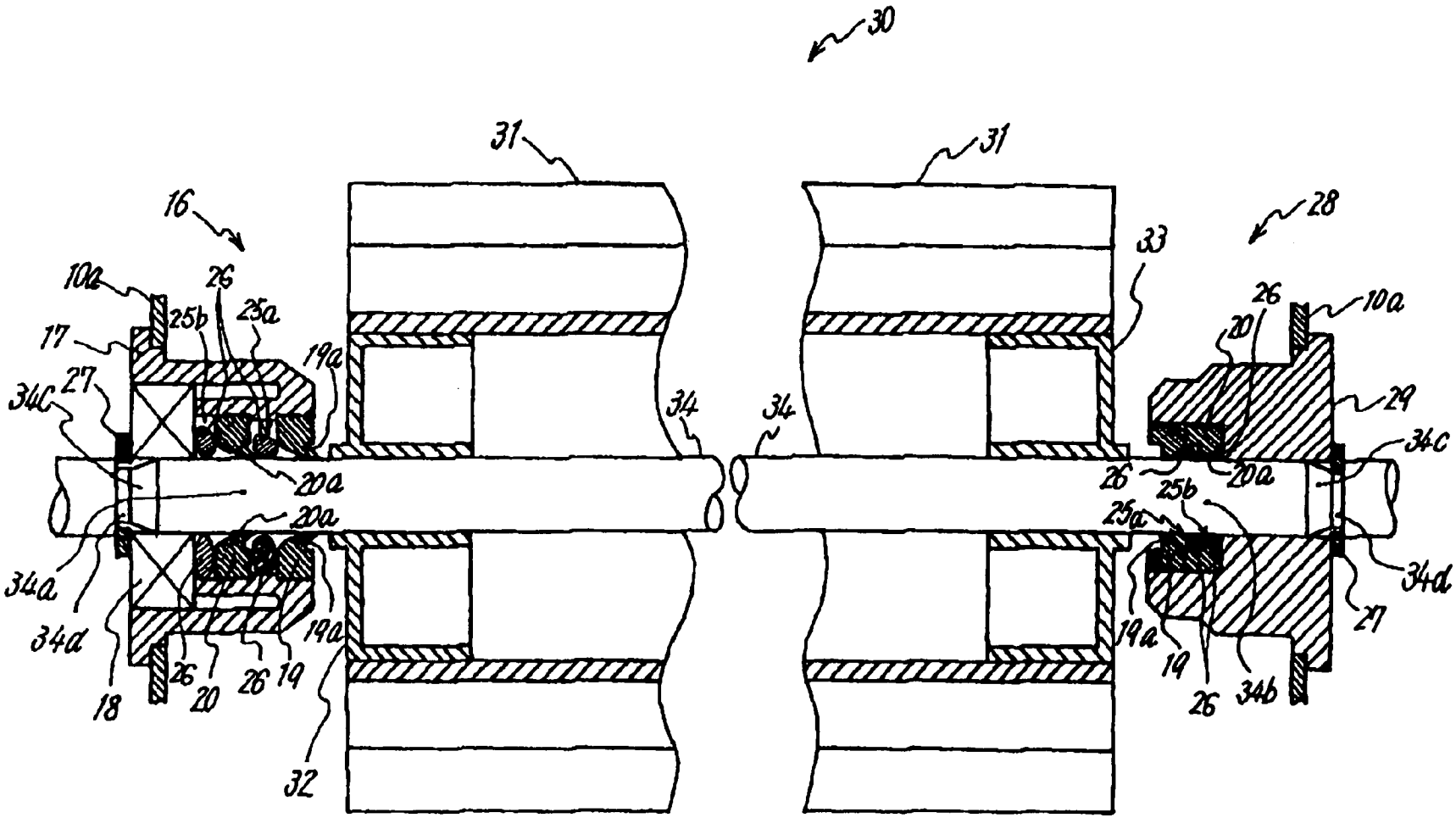
FIG. 12 is a section showing a modification of the fourth embodiment.

While the shaft portions slidingly contacting the slide bearings 28 and the shaft portions which the seal lips 19*a* and 20*a* contact are provided with the same diameter, the former may be provided with a smaller diameter than the latter. Further, as shown in FIG. 12, considering the fact that the load to act on the shaft portion 34*a*, located at the drive input side, is heavier than the load to act on the other shaft portion 34*b*, the shaft portion 34*a* may be supported by the ball bearing 18 of the third embodiment.

In the first to third embodiments shown and described, the bearing case or holding member 17 is implemented as a molding of polyacetal resin or similar crystalline resin. Experience teaches that a molding of crystalline resin cracks less than a molding of ABS or similar resin when subject to the influence of grease and stresses ascribable the press-fitting of seal members. Therefore, the bearing case 17, implemented as a molding of polyacetal resin, cracks little despite the above stresses, thereby preventing grease from leaking to the outside. It follows that stable sealing is insured over a long period of time. Again, PBT is another crystalline resin applicable to the bearing case 17. Further, the bearing case 17 formed of resin is low cost because it does not need machining.

In the first modification of the first embodiment, glass fibers, contained in, e.g., crystalline resin or ABS resin constituting the bearing case 17, provide the bearing case 17 with high accuracy by reducing shrinkage ascribable to molding and therefore accurately maintain the inside diameter of the seal lips 19*a* and 20*a* and the outside diameter of the base portion 23*a* coaxial with each other. This insures a high sealing ability and protects the seal lips 19*a* and 20*a* from local wear for thereby enhancing the durability of the G-seals 19 and 20.

In second modification of the first embodiment, the bearing case 17 is formed of aluminum or similar metal instead of resin and produced by machining. The bearing case 17 achieves higher mechanical strength and accuracy when formed of metal than when implemented as a resin molding and is therefore free from cracks and achieves a high sealing ability and durability.

Further, in the third and fourth embodiments, a single paddle shaft 34 extends throughout the blade body and is provided with a pair of bearings at opposite ends thereof. The paddle shaft 34 therefore oscillates less than a pair of paddle shafts during rotation, enhancing the sealing and durability of the bearing portions.

Various modifications will become possible for those skilled in the art after receiving the teachings of the present disclosure without departing from the scope thereof.

What is claimed is:

1. A bearing seal structure for a developing device included in an image forming apparatus, said bearing seal structure comprising:

a first seal member and a second seal member included in a bearing portion and each having a respective elastic seal lip configured to seal an outer periphery of a shaft in contact with said outer periphery; and grease sealed between said first seal member and said second seal member and between one of said first seal member and said second seal member closer to said bearing portion than the other and said bearing portion.

2. The structure as claimed in claim 1, further comprising a holding member configured to hold said first seal member and said second seal member.

3. The structure as claimed in claim 2, wherein said holding member is formed of crystalline resin.

4. The structure as claimed in claim 2, wherein said holding member is formed of resin containing glass fibers.

5. The structure as claimed in claim 2, wherein said holding member is formed of metal.

6. In a developing device for an image forming apparatus and including a bearing seal structure, said bearing seal structure comprising:

a first seal member and a second seal member included in a bearing portion and each having a respective elastic seal lip configured to seal an outer periphery of a shaft in contact with said outer periphery; and grease sealed between said first seal member and said second seal member and between one of said first seal member and said second seal member closer to said bearing portion than the other and said bearing portion.

7. The device as claimed in claim 6, wherein said bearing structure is applied to bearing portions configured to rotatably support opposite ends of a single rotary shaft.

8. An image forming apparatus comprising:

an image carrier; and a developing device configured to develop a latent image formed on said image carrier;

said developing device including a bearing seal structure comprising:

a first seal member and a second seal member included in a bearing portion and each having a respective elastic seal lip configured to seal an outer periphery of a shaft in contact with said outer periphery; and grease sealed between said first seal member and said second seal member and between one of said first seal member and said second seal member closer to said bearing portion than the other and said bearing portion.

9. The apparatus as claimed in claim 8, wherein said bearing structure is applied to bearing portions configured to rotatably support opposite ends of a single rotary shaft.

* * * * *